US009964289B2

(12) United States Patent
Pearson et al.

(10) Patent No.: US 9,964,289 B2
(45) Date of Patent: May 8, 2018

(54) LED LIGHT FIXTURES HAVING PLUG-TOGETHER LIGHT FIXTURE MODULES

(71) Applicants: Dennis Pearson, Foothill Ranch, CA (US); Michael D. Bremser, Seal Beach, CA (US); Dennis Barton, Costa Mesa, CA (US); James Johnson, Lake Forest, CA (US); Thomas Lueken, Beaumont, CA (US)

(72) Inventors: Dennis Pearson, Foothill Ranch, CA (US); Michael D. Bremser, Seal Beach, CA (US); Dennis Barton, Costa Mesa, CA (US); James Johnson, Lake Forest, CA (US); Thomas Lueken, Beaumont, CA (US)

(73) Assignee: Tempo Industries, LLC, Irvine, CA (US)

( * ) Notice: Subject to any disclaimer, the term of this patent is extended or adjusted under 35 U.S.C. 154(b) by 228 days.

(21) Appl. No.: 15/081,763

(22) Filed: Mar. 25, 2016

(65) Prior Publication Data

US 2017/0276332 A1 Sep. 28, 2017

(51) Int. Cl.
*F21S 4/28* (2016.01)
*F21V 21/005* (2006.01)
(Continued)

(52) U.S. Cl.
CPC ..... *F21V 21/005* (2013.01); *F21K 9/272* (2016.08); *F21K 9/278* (2016.08); *F21V 23/06* (2013.01);
(Continued)

(58) Field of Classification Search
CPC ..... F21S 4/28; F21Y 2103/10; F21K 9/27; F21K 9/272
(Continued)

(56) References Cited

U.S. PATENT DOCUMENTS 2,288,941 A * 7/1942 Curtis ..... F21V 17/00 174/96
3,030,670 A 4/1962 Bigelow
(Continued)

FOREIGN PATENT DOCUMENTS

DE 102009016753 A1 10/2010
DE 102010001777 A1 8/2011
(Continued)

OTHER PUBLICATIONS

EPO 15159756.4 extended European search report, dated Apr. 12, 2015.

*Primary Examiner* — Ismael Negron
(74) *Attorney, Agent, or Firm* — Lapple Ubell IP Law, LLP; Franklin D. Ubell

(57) ABSTRACT

An LED light fixture having adjacent interconnected light fixture modules, each comprising a power system extrusion, an LED light module body attachable to the power system extrusion, female and male end caps at opposite ends of each extrusion and respectively including a female electrical connector and a male electrical connector, a male electrical connector being configured to plug into the female electrical connector of an adjacent extrusion, and a power box component having a female electrical connector configured to plug into a male electrical connector of a male end cap.

18 Claims, 13 Drawing Sheets

(51) Int. Cl.

| | |
|---|---|
| ***F21K 9/272*** | (2016.01) |
| ***F21K 9/278*** | (2016.01) |
| ***F21V 23/06*** | (2006.01) |
| ***F21V 29/508*** | (2015.01) |
| *F21Y 103/10* | (2016.01) |
| *F21Y 115/10* | (2016.01) |

(52) U.S. Cl.
CPC ..... *F21V 29/508* (2015.01); *F21Y 2103/10* (2016.08); *F21Y 2115/10* (2016.08)

(58) Field of Classification Search
USPC ..... 362/219
See application file for complete search history.

(56) References Cited

U.S. PATENT DOCUMENTS 5,226,724 A * 7/1993 Kanarek ..... F21S 2/00 362/151
5,620,369 A 4/1997 Spransy et al.
5,702,176 A * 12/1997 Engle ..... F21S 2/00 362/219
6,351,920 B1 3/2002 Hopkins et al.
6,585,393 B1 * 7/2003 Brandes ..... A47F 3/001 362/219
6,670,626 B2 * 12/2003 Witham ..... A61L 2/10 250/493.1
7,182,637 B2 * 2/2007 Coyle, Jr. ..... H01R 13/743 439/281
7,282,728 B2 * 10/2007 Culbert ..... A61L 9/20 250/504 R
7,331,687 B1 * 2/2008 Noh ..... F21S 2/00 362/217.05
7,353,071 B2 4/2008 Blackwell et al.
7,405,715 B2 7/2008 Guzman et al.
7,703,941 B2 * 4/2010 Lee ..... G09F 9/33 362/217.17
7,726,840 B2 6/2010 Pearson et al.
8,002,426 B2 8/2011 Pearson et al.
8,061,870 B2 11/2011 Pearson et al.
8,398,276 B2 3/2013 Pearson et al.
8,742,694 B2 6/2014 Bora et al.
8,860,326 B2 10/2014 Cahalane et al.
9,004,716 B2 * 4/2015 Ai ..... F21S 2/00 362/217.17
9,217,247 B2 12/2015 Behling et al.
9,395,052 B1 * 7/2016 Shew ..... F21K 9/27
9,726,331 B1 * 8/2017 May ..... F21V 7/00
2006/0238136 A1 10/2006 Johnson, III et al.
2007/0274067 A1 * 11/2007 Sloan ..... F21V 15/015 362/219
2010/0259931 A1 10/2010 Chemel et al.
2012/0051041 A1 3/2012 Edmond et al.
2012/0063138 A1 3/2012 Leadford et al.
2012/0091903 A1 4/2012 Bembridge et al.
2012/0235579 A1 9/2012 Chemel et al.
2012/0280637 A1 11/2012 Tikkanen et al.
2013/0021792 A1 1/2013 Snell et al.
2013/0070461 A1 3/2013 Pickard
2013/0176722 A1 7/2013 Lay et al.
2013/0208457 A1 8/2013 Durkee et al.
2013/0208469 A1 8/2013 Progl
2013/0249405 A1 9/2013 Cahalane et al.
2013/0250567 A1 9/2013 Edmond et al.
2013/0265764 A1 10/2013 Holman et al.
2013/0271979 A1 10/2013 Pearson et al.
2013/0272000 A1 10/2013 Pearson et al.
2013/0279165 A1 10/2013 Pearson et al.
2013/0279179 A1 10/2013 Pearson et al.
2013/0279180 A1 10/2013 Pearson et al.
2014/0307438 A1 10/2014 Pearson
2015/0016106 A1 1/2015 Belliveau et al.
2015/0070882 A1 * 3/2015 Ohno ..... F21K 9/20 362/219
2016/0003457 A1 1/2016 Pearson et al.
2016/0014869 A1 1/2016 Pearson et al.
2016/0298832 A1 10/2016 Pearson et al.
2016/0327217 A1 11/2016 Pearson et al.
2017/0138578 A1 5/2017 Pearson et al.

FOREIGN PATENT DOCUMENTS

WO 2011139764 A2 11/2011
WO 2012129243 A1 9/2012

* cited by examiner

LED LIGHT FIXTURES HAVING PLUG-TOGETHER LIGHT FIXTURE MODULES

FIELD OF THE DISCLOSURE

The subject disclosure relates to LED electric lighting fixtures, and more particularly to LED light fixture apparatus having adjacent light fixture modules which plug into one another and which feature flexible positioning of individual LED light modules along the length of a light fixture module, as well as flexible orientation of illumination direction in either an upward indirect mode or a downward direct mode.

DESCRIPTION OF RELATED ART

Various LED electric light fixtures have been constructed in the past, for example, such as those disclosed in U.S. Pat. Nos. 7,726,840 and 8,864,347, both assigned to Tempo Industries, LLC.

SUMMARY OF THE DISCLOSURE

According to an illustrative embodiment, an LED light fixture module may comprise one or more LED modules mounted to a power system extrusion. An interior floor of the power system extrusion has opposing horizontally facing channels formed therein, while an interior sidewall of the extrusion has a horizontally running channel which mounts an electrical connector configured to transfer power from electrical cables running through the extrusion to an LED driver mounted within a chamber defined within the LED module-power system extrusion assembly.

A female end cap is shaped to close a first end of the chamber and has a horizontally extending tongue, which is shaped and dimensioned to enable the horizontally extending tongue to slide into the horizontally facing channels on the floor of the power system extrusion. The female end cap further carries a centrally positioned female electrical connector and has respective slots formed in a front face thereof.

A male end cap is also provided which has a horizontally extending tongue which is shaped and dimensioned to enable the horizontally extending tongue to slide into the horizontally facing channels. The male end cap further has a centrally positioned male electrical connector configured to mate with the female electrical connector of a female end cap, as well as first and second tongues projecting from a vertical front face thereof, which are shaped to mate with the first and second slots of a female end cap.

A power box component is further provided having respective slots positioned to mate with the respective tongues projecting from the front face of the male end cap and a female electrical connector configured to mate with the male electrical connector of the male end cap. The power box component also has an electrical cable extending through a surface thereof and configured to attach to a source of electrical power external to the fixture, for example, such as a junction box.

In one embodiment, an LED driver module is located within the chamber defined by the LED module and power system extrusion and is attached to a spring biased mounting bracket which presses a surface of the driver module against an interior floor of the power system extrusion so as to improve heat transfer between the driver and the extrusion.

DETAILED DESCRIPTION OF ILLUSTRATIVE EMBODIMENTS

Figure 1:
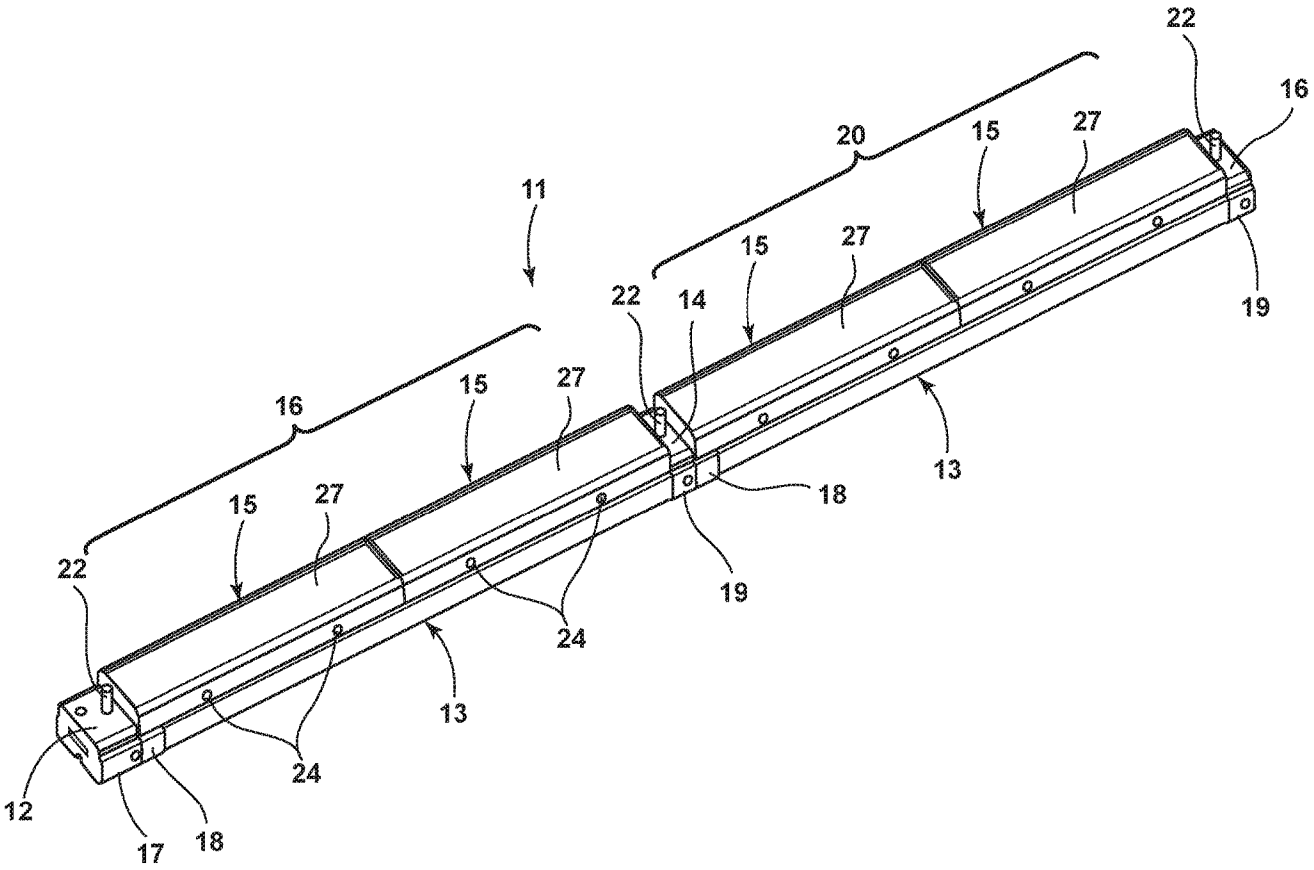
FIG. 1 is a perspective view of an LED light fixture according to a first illustrative embodiment.

One illustrative embodiment of an LED light fixture 11 according to the illustrative embodiments is shown in FIG. 1. The illustrative fixture 11 includes a pair of light fixture modules 16, 20. Each light fixture module 16, 20 includes a male end cap slip fitter component 18, a female end cap slip fitter component 19 a power system extrusion 13 and one or more LED light modules 15. Two LED light modules 15 per power system extrusion 13 are shown in the particular embodiment of FIG. 1, but the number may differ in different embodiments, for example, comprising as many as eight or more LED light modules 15 per power system extrusion 13 in some embodiments. In one embodiment, the power system extrusion 13 may be extruded aluminum and the LED modules 15 may comprise a module body or housing formed of die cast aluminum, for example A380 alloy aluminum. The extrusion 13 and modules 15 may of course be made of other materials in other embodiments. In one embodiment, each of the power system extrusions 13 may be of the same length, for example, four feet, but may be of differing lengths in other embodiments.

In the illustrative embodiment, each LED light module 15 directs LED-generated light through a respective lens 27. As known in the art, in various embodiments lenses may be used to tailor the light output pattern of the LED's in a desired manner. In various embodiments, lenses may also protect the LEDs and/or assist in sealing the modules 15.

In the illustrative embodiment, each LED module 15 is attached to a power system extrusion 13 by respective screws, e.g. 24. Thus, each light module 24 may be removed for repair or replacement without disassembling the rest of the fixture 11. In other embodiments, the LED light modules 15 may be attached to the power system extrusion 13 in other manners.

In the embodiment shown in FIG. 1, at a first end of the fixture 11, a power box 17 interconnects with a first male end cap slip fitter component 18, which in turn interconnects with the first power system extrusion 13. The first and second power system extrusions 13 are interconnected by mating engagement between a first female end cap slip fitter component 19 and a second male end cap slip fitter component 18. A second female end cap slip fitter component 19 interconnects with the second power system extrusion 13 at the second or opposite end of the fixture 11.

In the illustrative embodiment, the power box 17 and each of the first and second female slip fitter components 19 has a cable gripper 22 projecting vertically from a respective top surface 12, 14, 16 thereof, which facilitates attachment of cables or other mechanisms to suspend the fixture 11, for example, from a ceiling, electrical junction box, and/or T-bar structure. Thus, the embodiment of FIG. 1 may be characterized as a pendant version, where light is directed upwardly through the lenses 27 so as to create an indirect lighting effect.

Figure 2:
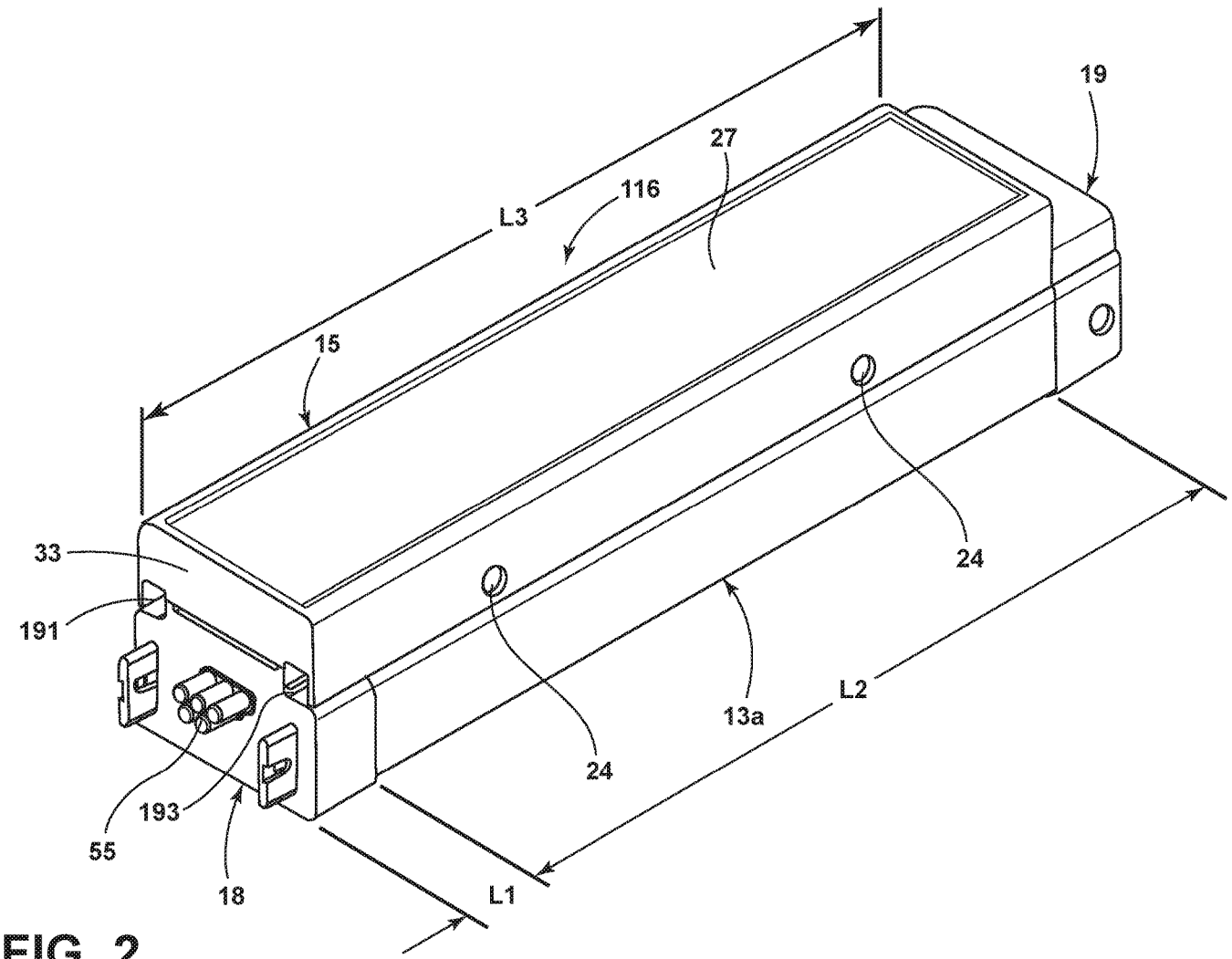
FIG. 2 is an exploded perspective view of an LED light fixture according to a second illustrative embodiment.

FIG. 2 shows another illustrative embodiment of a light fixture module 116 employing a single LED light module 15 mounted to a power system extrusion 13*a*. In an illustrative embodiment, the LED light module 15 may be one foot in overall length. Other lengths could of course be used in other embodiments.

The power system extrusion 13*a* is closed at one end by a male end cap slip fitter component 18, which has a five pin male connector. At the other end, the extrusion 13*a* is closed by a female end cap slip fitter component 19, which has a five receptacle female connector 39 (FIG. 3) configured to mate with a connector such as 5 pin male connector 55.

Figure 3:
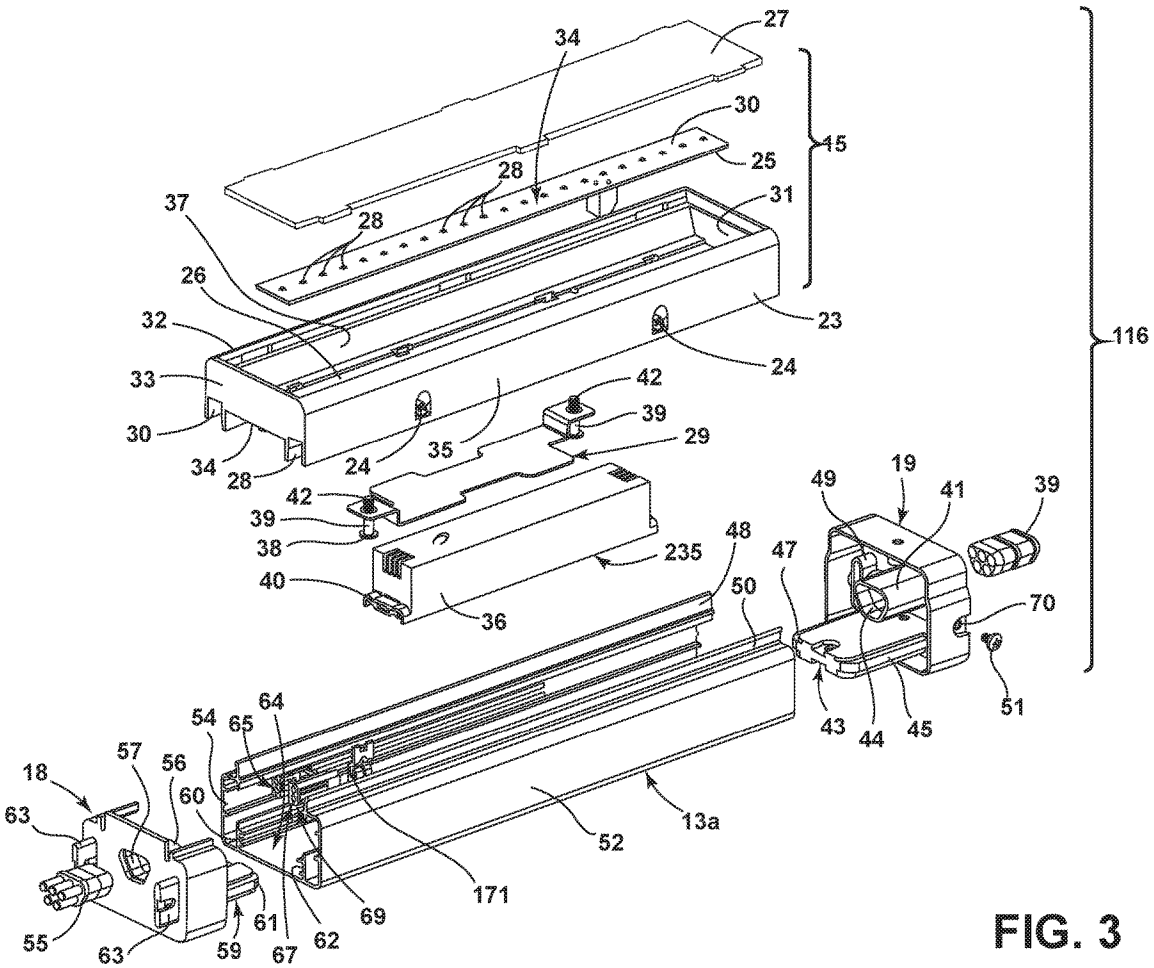
FIG. 3 is an exploded perspective view of the embodiment of FIG. 2.

FIG. 3 shows an exploded view of the illustrative light fixture embodiment of FIG. 2. As shown, the LED light module 116 includes an LED light module 15 having a module body 23, a lens 27, an LED circuit board 25 mounting one or more LEDs or LED devices, e.g. 28, on a top surface 30 thereof. In the illustrative embodiment, the module body 23 has a rectangular perimeter defined by respective parallel vertical end walls 31, 33, and respective parallel vertical sidewalls 35, 37.

In one embodiment, the lens 27 is a generally rectangular, flat, frosted lens. In the illustrative embodiment, the LED circuit board 25 is attached to a floor 26 of the module body 23 and is recessed a selected distance from the top edge 32 of the module body 23, thereby providing a selected cut-off of the illumination provided by the LEDs 28. Respective channels 28, 30 are formed at respective lower sides of the module body 23.

An LED driver module 235 for powering the LEDs 28 attaches to a driver mounting bracket 29, which in turn is attached to a bottom surface 34 of the module body 23 by respective screws 42, which in one embodiment may thread into respective bosses formed on the bottom surface 34. In one embodiment, the driver module 235 comprises a driver case base 40 and a driver base cover 36.

Figure 5:
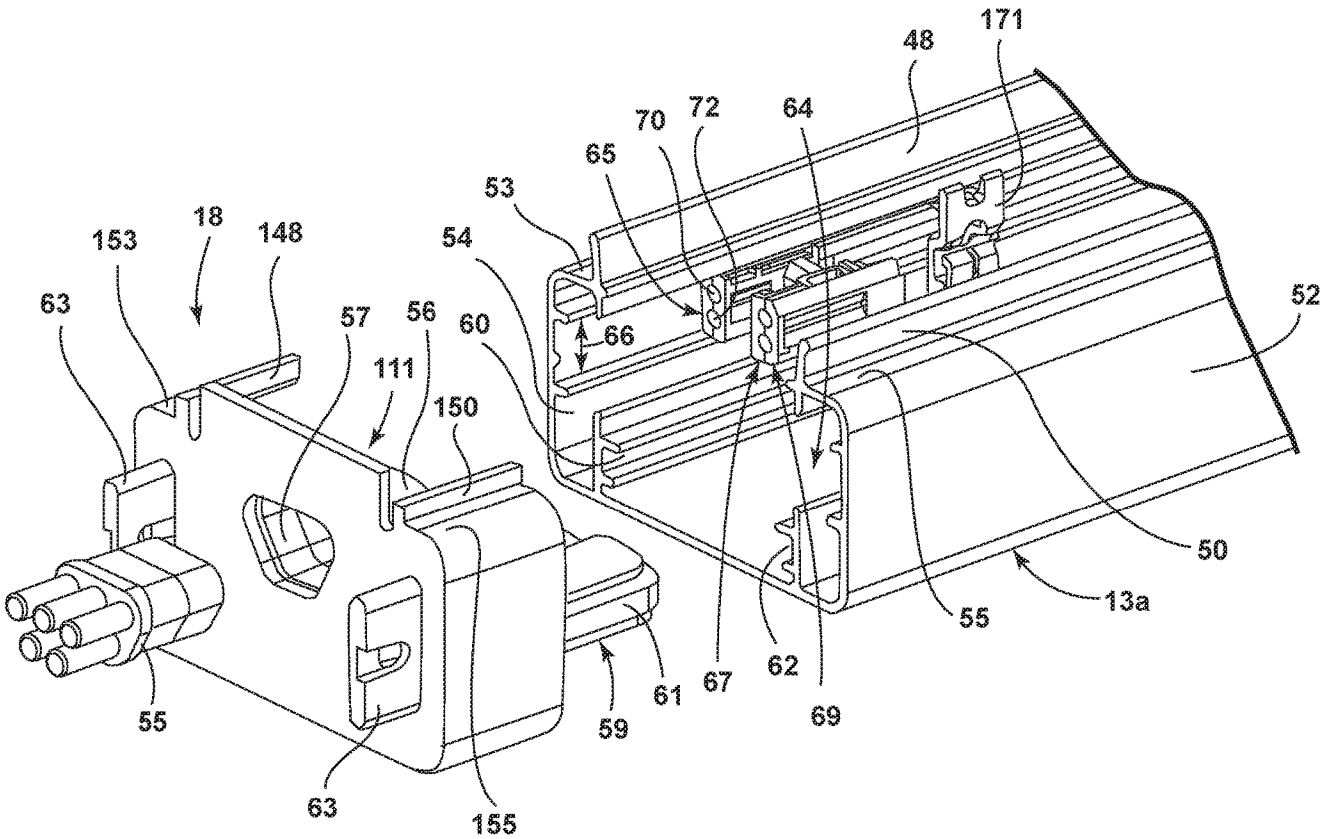
FIG. 5 is an enlarged perspective view of a first portion of the embodiment of FIG. 3.
Figure 6:
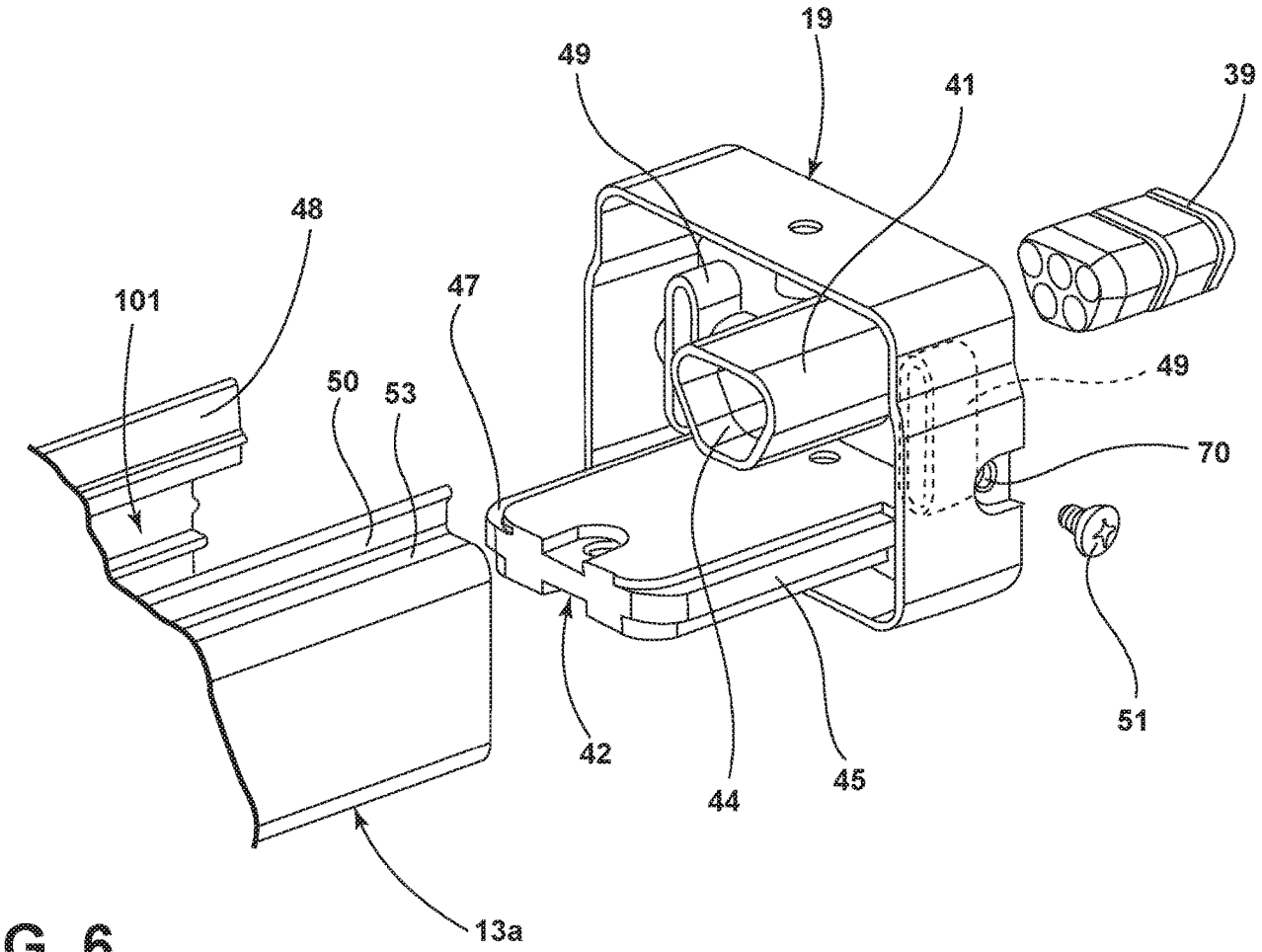
FIG. 6 is an enlarged perspective view of a second portion of the embodiment of FIG. 3.

The power system extrusion 13*a* has a hollow interior located between respective vertical side surfaces 52, 54. As shown in FIG. 5, each side surface 52, 54, curves into a respective horizontal top surface segment 53, 55, from which extend respective horizontally running upwardly extending wing surfaces 48, 50, which run the length of the power system extrusion 13*a* and define a generally rectangular opening 101 between them as shown in FIG. 6. In the illustrative embodiment, each of the wings 48, 50 is angled outwardly slightly from the vertical. The power system extrusion 13 of FIG. 1 may be constructed in the same or similar fashion to the power system extrusion 13*a*.

Figure 4:
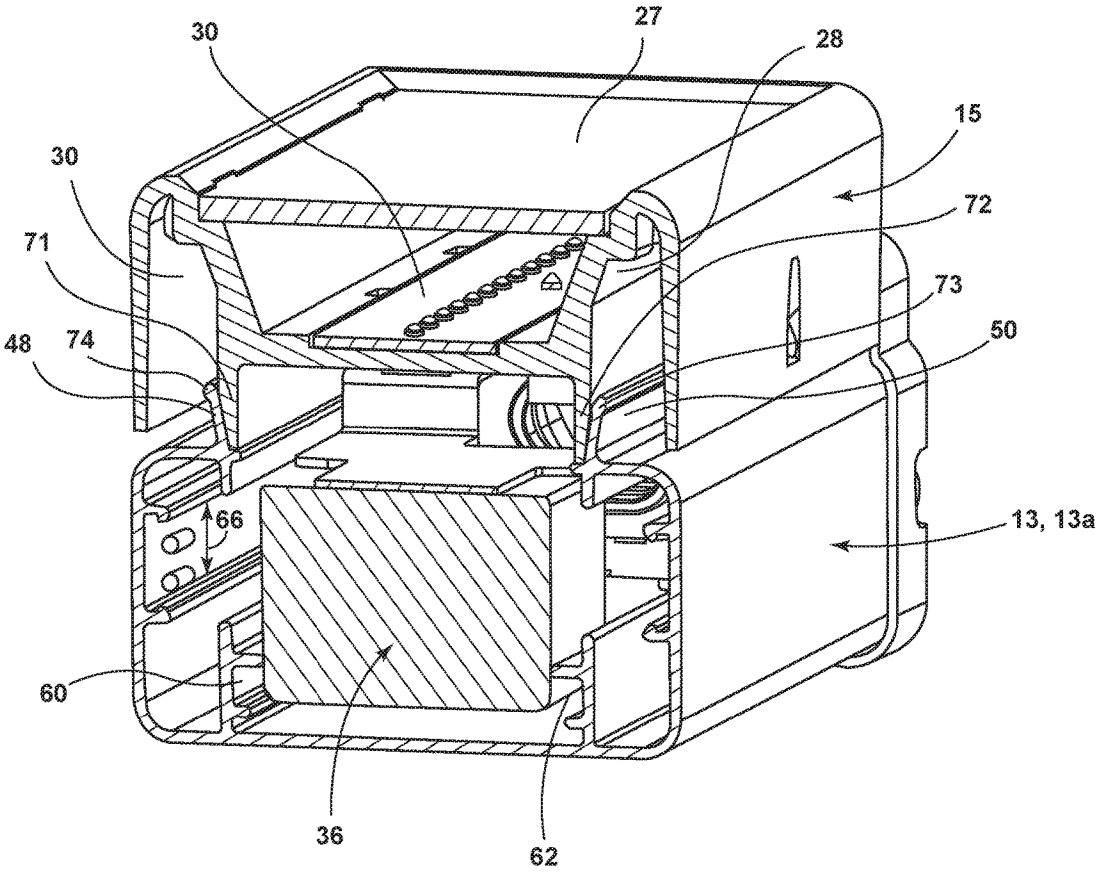
FIG. 4 is a cross-sectional view of an illustrative embodiment.

FIG. 4 illustrates how the LED light module 15 is attached to a power system extrusion 13 or 13*a* and is shaped so as to close the rectangular opening 101 in the extrusion 13, 13*a*, so as to define a closed interior chamber in which the LED driver module 235 is located. In the illustrative embodiment, closure is achieved via abutment or engagement between the outer side surfaces of the inner walls 71,72 of the channels 28, 30 formed in the LED module 15 and the respective inner side surfaces of each respective wing 48, 50.

In one embodiment, respective self-threading screws 24 as shown in FIG. 3 are angled and screwed into the power system extrusion 13, 13*a* in order to fasten each LED module 15 to the power system extrusion 13, 13*a* in manner which provides contact between the components 15 and 13 or 13*a* which is tight enough to increase heat transfer between the components 15 and 13 or 13*a* to optimize such transfer for thermal management purposes. In one embodiment, extended tips 73, 74, are provided on the wings 48, 50 of the power system extrusion 13, 13*a*. In such an embodiment, the tips 73, 74, extend above the ends of the mounting screws and are shaped and dimensioned such that, if the LED module 15 is properly mated and aligned with the power system extrusion 13 or 13*a*, the screws 24 will bite in and pull the units, e.g. 15 and 13*a*, more tightly together, whereas, if the units are misaligned the screws will not bite and hold at all.

As further shown in FIGS. 3 and 5, an electrical connector 67 having respective connector halves 65, 69 is mounted on one interior sidewall 54 of the power system extrusion 13*a*. In one embodiment, the electrical connector 67 is shaped and dimensioned to snap fit into a channel 66 formed in the interior sidewall 54.

Figure 13:
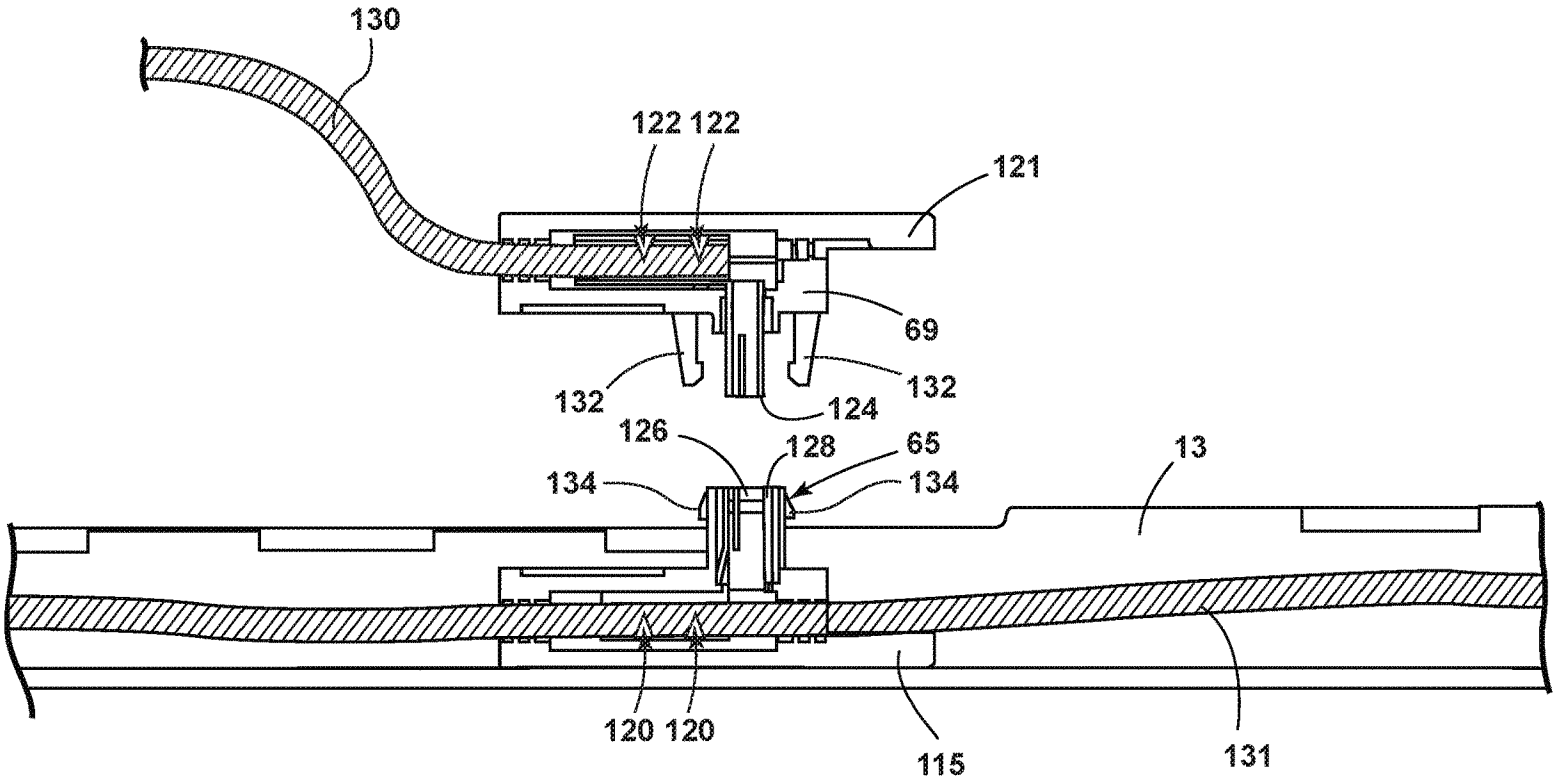
FIG. 13 is a side sectional view of an illustrative electrical connector according to one embodiment.

As illustrated in FIG. 13, in one embodiment, a male electrical connector 124 electrically connected to insulation piercing pins 122 is configured to plug into an opening 126 in a female receptacle 128 electrically connected to insulation piercing pins 120 to establish electrical continuity between electrical leads 131 and the leads 130 which supply power to the LED power supply or driver 235. In one embodiment, a snap fit mechanism comprising flexible tabs 132 configured to engage projections 134 may be provided to secure components 65 and 69 together. The illustrative embodiment of FIGS. 3 and 13 enables ease of electrical connection and disconnection during manufacturing and repair or replacement of the LED driver 235.

In one embodiment, respective line voltage leads 131 (e.g. 120 volts A.C.) pass through the connector half 65 and are pierced to tap power off to the inputs of the LED driver 235 via respective leads 130 of the second connector half 69, as illustrated in FIG. 13. The wire management clip 171 in FIG. 3 serves to assist in guiding the line voltage leads 131 to the connector 65. In one embodiment, the clip 171 also is shaped and dimensioned to snap into the channel 66 of the power system extrusion, e.g. 13.

As shown in FIGS. 3 and 5, the inside surface of the illustrative male end cap slip fitter component 18 has an inwardly extending horizontal tongue 59 with lips 61 formed on opposite sides thereof and shaped and dimensioned to enable the tongue 59 to penetrate and slide into the respective horizontally facing u-shaped channels 60, 62, which run the length of the power system extrusion 13*a*. The outer vertical surface of male slip fitter component 18 has a receptacle 56 with an opening 57 shaped to receive the 5 pin male connector 55. Respective tongues 63 are formed on opposite sides of the vertical front face of the male end cap slip fitter 18.

As shown in FIG. 5, the male end cap slip fitter 18 further has respective horizontal top surface segments 153, 155, from which extend respective horizontally running upwardly extending wing surfaces 148, 150, which run the length of the top surface segments 153, 155 and define a generally rectangular opening 111 between them. In the illustrative embodiment, each of the wings 148, 150 is angled outwardly slightly from the vertical and is shaped and positioned so as to abut the horizontally running wings 48, 50 (FIG. 4) of the power system extrusion and to contact the interior side surfaces 71, 72 (FIG. 4) of the LED module 15. As seen in FIG. 2, in an illustrative embodiment, the length L1 of the male end cap slip fitter component 1 plus the length L2 of the power system extrusion 13*a* is equal to the overall length L3 of the LED module 15 such that the vertical front face of the male end cap 18 and the vertical end wall 33 of the LED module 15 flushly align with one another.

As shown in FIGS. 3 and 6, the female end cap slip fitter 19 is shaped to close one end of the chamber between the LED module 15 and the power system extrusion 13 and has an inwardly extending horizontal tongue with lips 45, 47 formed on opposite sides thereof. The lips 45, 47 are also shaped and dimensioned to slide and engage with the respective channels 60, 62 of the power system extrusion 13*a*. A receptacle 41 formed in the female slip fitter 37 has an opening 44, which receives the 5 pin female connector insert 39. Respective slots 49 are formed in the front face of the female slip fitter 19 and are shaped and dimensioned to receive the respective tongues 63 projecting from the front of a male slip fitter component 18. In various embodiments, the slots 49 and tongues 63 mate, for example, in order to join the first and second power system extrusions 13 of FIG. 1. In one embodiment, screws, e.g. 51 (FIG. 3) may thread into suitable openings, e.g., 70 to lock the tongues 63 in place in the slots 49. It will be appreciated from the above discussion that in FIG. 1, for example, the first light fixture module 16 simply plugs in to the second light fixture module 20.

In one embodiment, the male and female connectors 55, 39 are shaped and dimensioned to mate with each other and to snap into place in the respective openings 57, 44, but could be held in place by other mechanisms in other embodiments, such as, for example, press-fit or adhesive bonding. In one embodiment, the trapezoidally-shaped five pin connectors may be formed of 5 VA rated plastic and provide line, neutral and ground interconnections, as well as two other interconnections, which enable provision of a second circuit to facilitate low voltage dimming or signal sensing in various embodiments.

Figure 7:
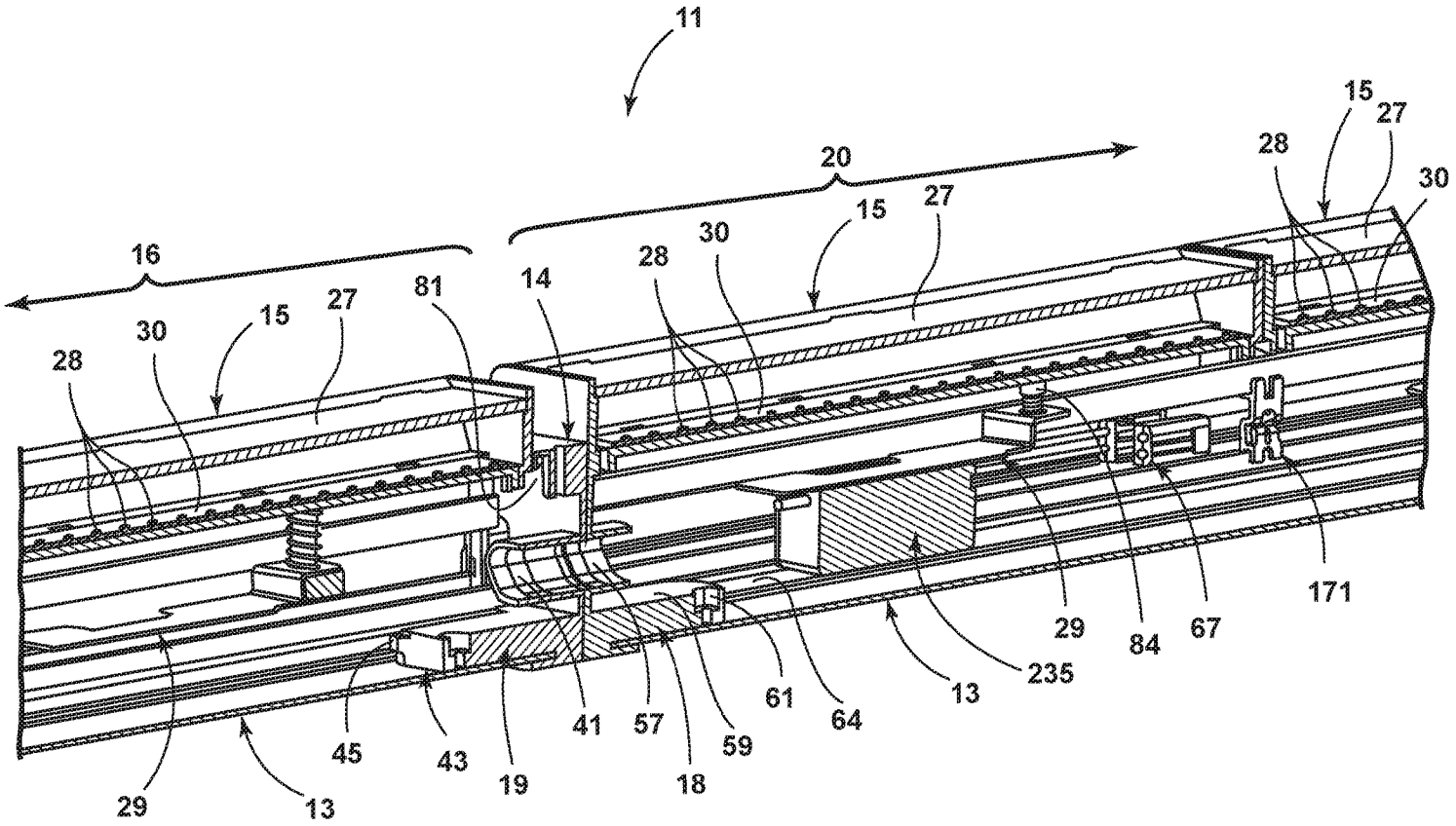
FIG. 7 is a fragmentary longitudinal cross-sectional view further illustrating the embodiment of FIG. 1.

FIG. 7 is a partial side sectional view illustrating further details of the embodiment of FIG. 1 in an assembled state. As may be seen, tongues 43 and 59 of the female and male end slip fitter components 19, 18 are inserted into the channels 60, 62 to secure those components in position. The respective receptacles 41, 57 carrying the five pin connectors 39, 55 abut one another. The five pin connectors 39, 55 themselves are omitted from FIG. 7 for illustrative purposes. The positioning and mounting of respective driver mounting plates 29 in each of the adjacent modules 16, 20 is also illustrated. The driver 235 in the left most module 16 has also been omitted for illustrative purposes.

Figure 8:
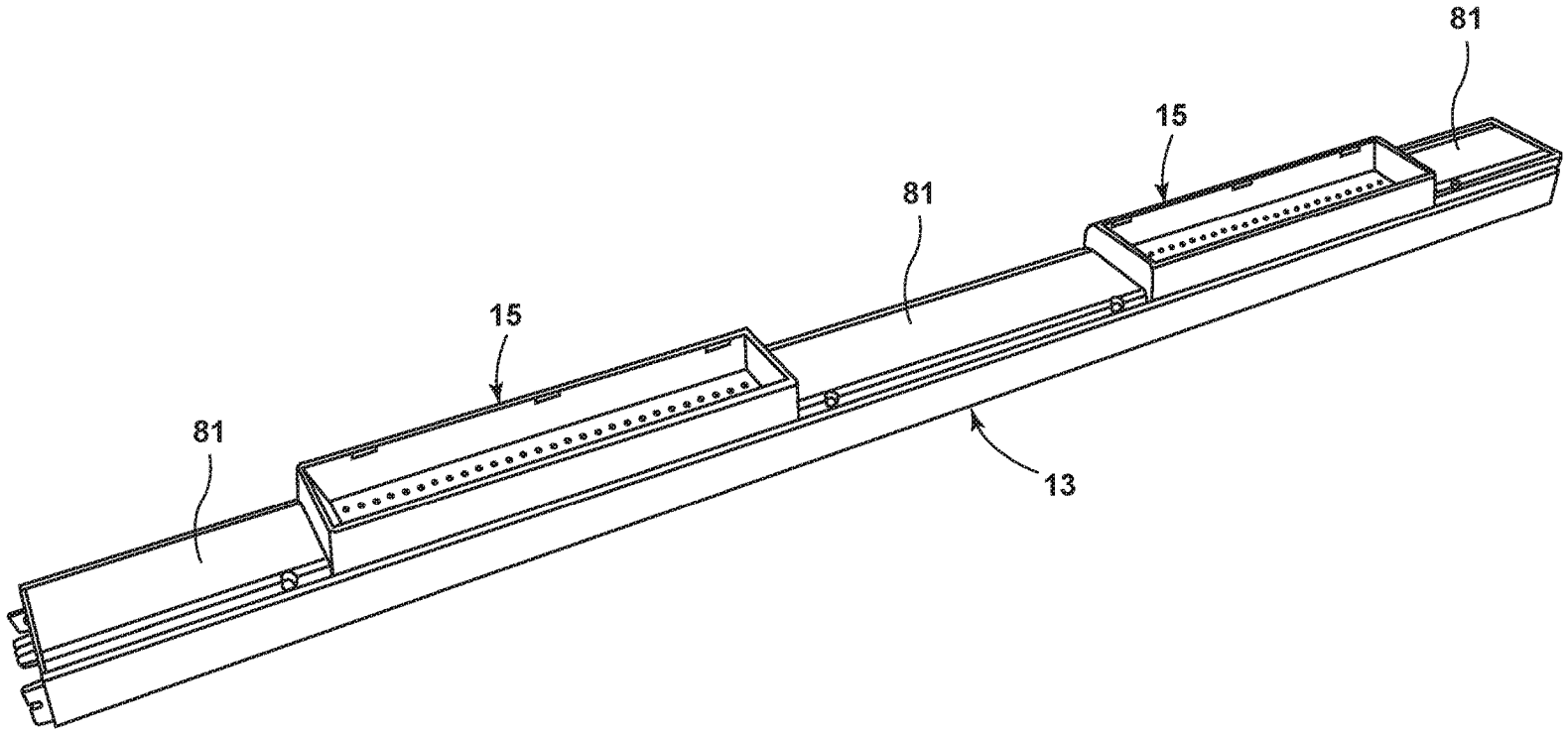
FIG. 8 is perspective view of an LED light fixture according to a third illustrative embodiment.

FIG. 8 illustrates another embodiment where the LED light modules 15 are spaced-apart by generally flat cover members 81. FIG. g 9 illustrates the module and cover assembly inverted and shows splice components 83 used to attach together the cover members 81 and modules 15 in linear order.

Figure 9:
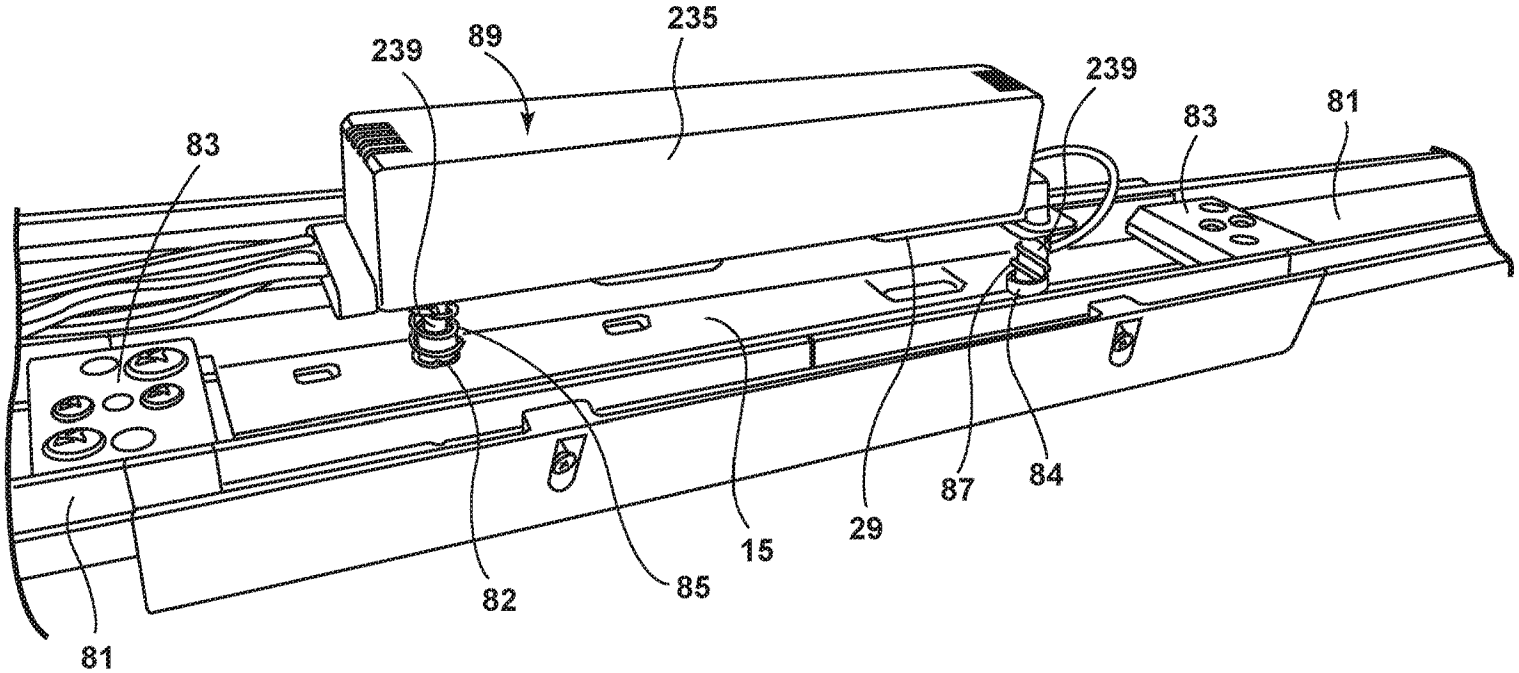
FIG. 9 is a fragmentary perspective view illustrating LED driver mounting apparatus according to an illustrative embodiment.

FIG. 9 further illustrates an illustrative mounting mechanism for the LED driver module 235. As may be seen, the LED mounting bracket screws 42 are threaded into respective bosses 82, 84 on the underside of the LED module 15 and are spring loaded by respective springs 85, 87. Respective sleeves 239 position the driver module 235 a distance away from the LED module 15 selected to cause the springs to be in compression when the module 15 is assembled to the power system extrusion 13 so as to press the flat surface 89 of the driver module 235 into the flat bottom floor 64 of the power system extrusion 13 as shown in FIG. 7 to thereby enhance or improve heat transfer from the driver 235 to the power system extrusion 13 for thermal management purposes. The flat sheet metal bracket 29 permits driver modules of various lengths to be employed and varying widths of driver modules are accommodated by the flat bottom floor 64 of the power system extrusion 13, 13*a*.

Figure 10:
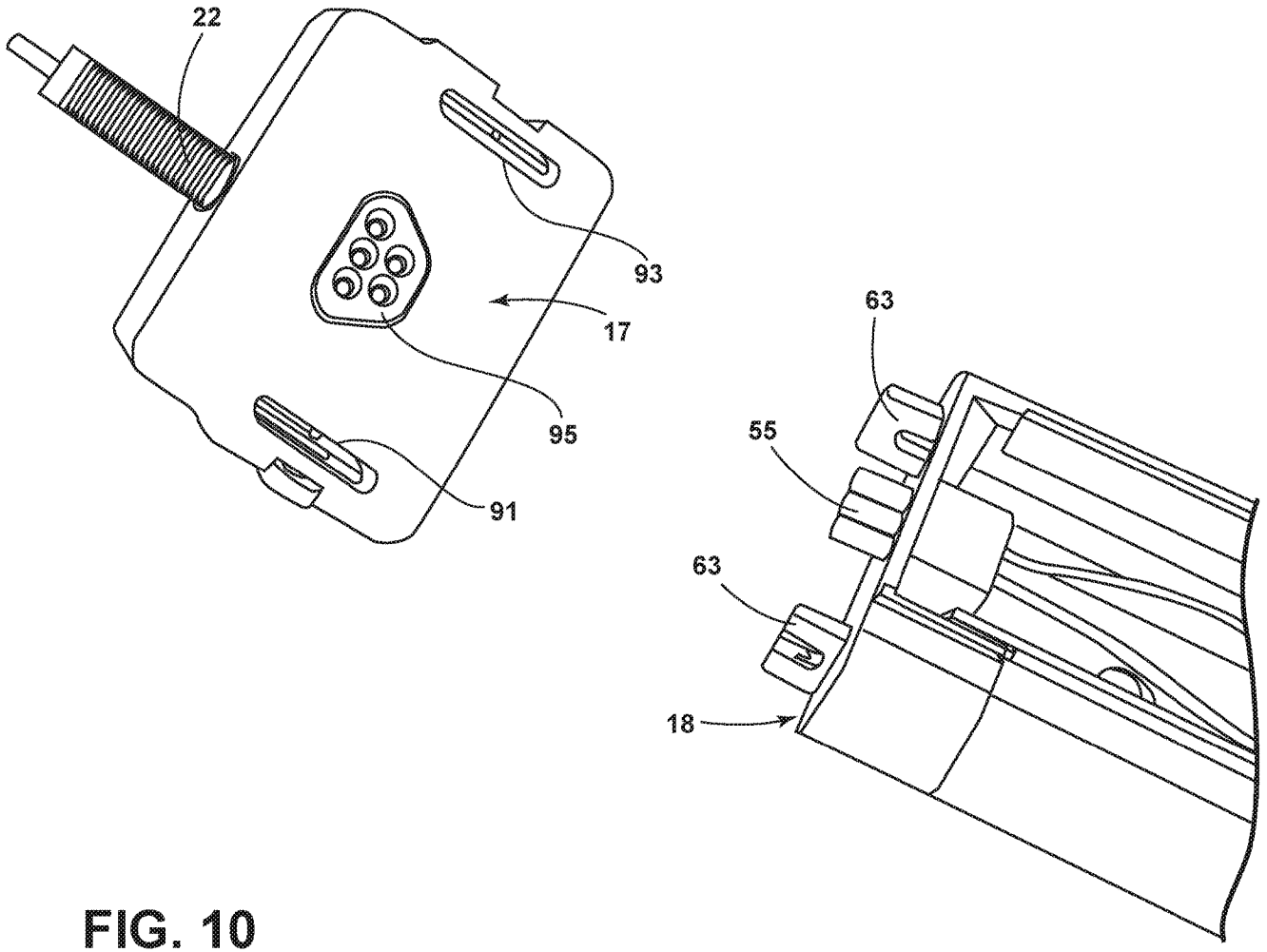
FIG. 10 is a perspective view illustrating a power box component of an illustrative embodiment.
Figure 11:
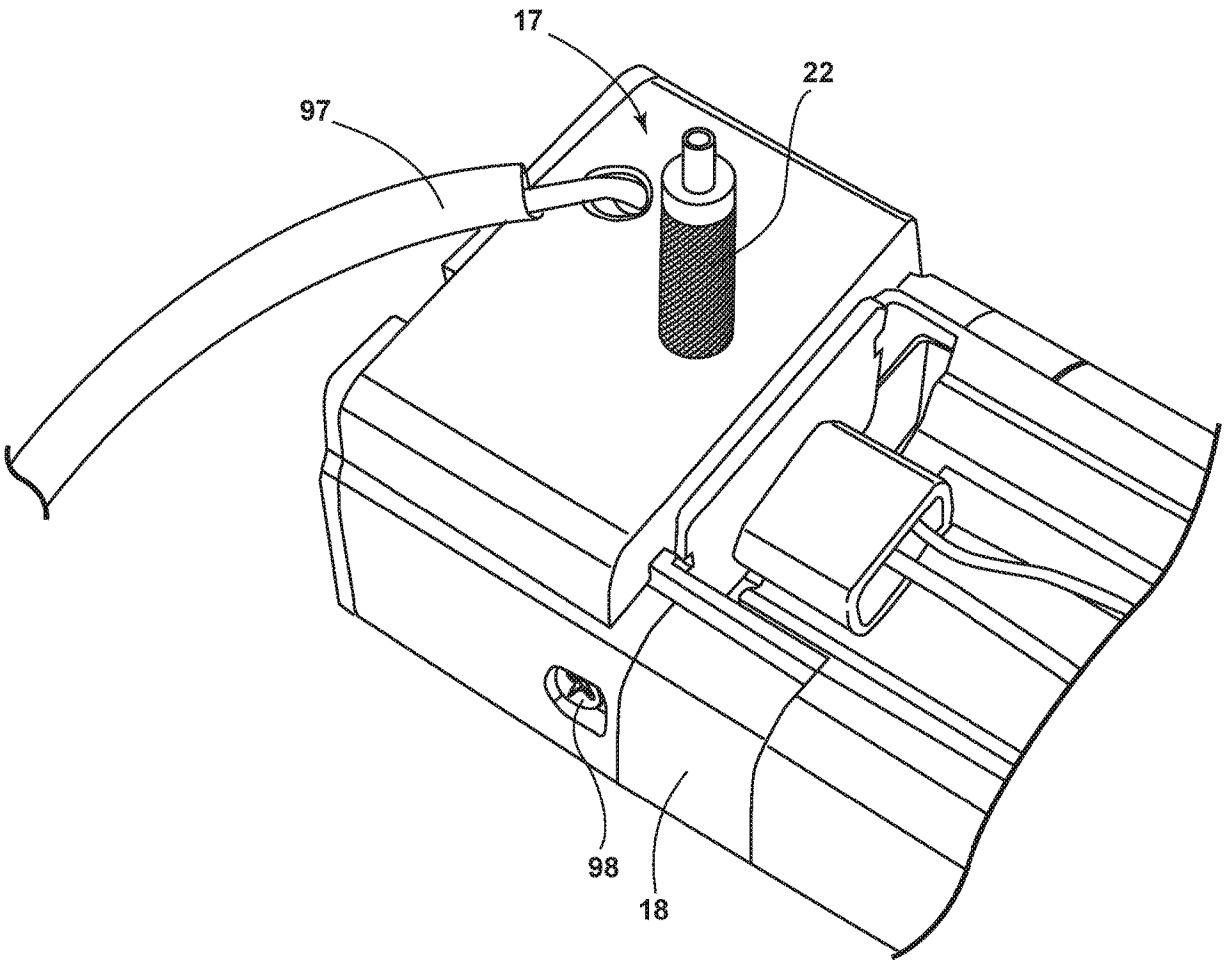
FIG. 11 is a perspective view further illustrating the power box of FIG. 10.

As FIGS. 10 and 11 further illustrate the power box 17 and its interface with a male slip fitter component. The power box 17 is generally rectangular in cross-section and has respective slots 91, 93 shaped and dimensioned to mate with respective tabs 63 of a male end cap slip fitter component 18. In one embodiment, the power box height is selected such that it covers openings 191, 193 (FIG. 2) between the male end cap slip fitter component 18 and the LED module 15.

The power box 17 includes a five receptacle female connector 95 shaped and dimensioned to mate with the five pin male connector 55 of the male end cap slip fitter 18. The five receptacle female connector 95 is supplied with power (e.g. 120 volts A.C.) via an electrical cable 97 which enters an opening in the top of the power box 17, as shown in FIG. 11. In assembly at the factory, the cable 97 is attached to the five pin female connector 95, which is then snapped into the central receptacle in the body of the power box 17. Thus, an electrician in the field does not have to go inside the fixture 11 to establish electrical connection to it, but rather may simply connect the cable 97 to a junction box and plug the power box 17 into the male end cap slip fitter 18. As may be seen in FIG. 11, in an illustrative embodiment, the power box 17 may be locked in place by a screw or other fastening device 98.

In illustrative embodiments, a power box 17 may begin a run of interconnected LED modules, e. g. 16, 20. In illustrative embodiments, LED light modules 15 may be mounted anywhere along the length of a power system extrusion 13, 13*a* but not covering the female end caps 19. LED light modules 15 may also be removed for service or replacement without the need to disassemble the rest of the fixture.

Figure 12:
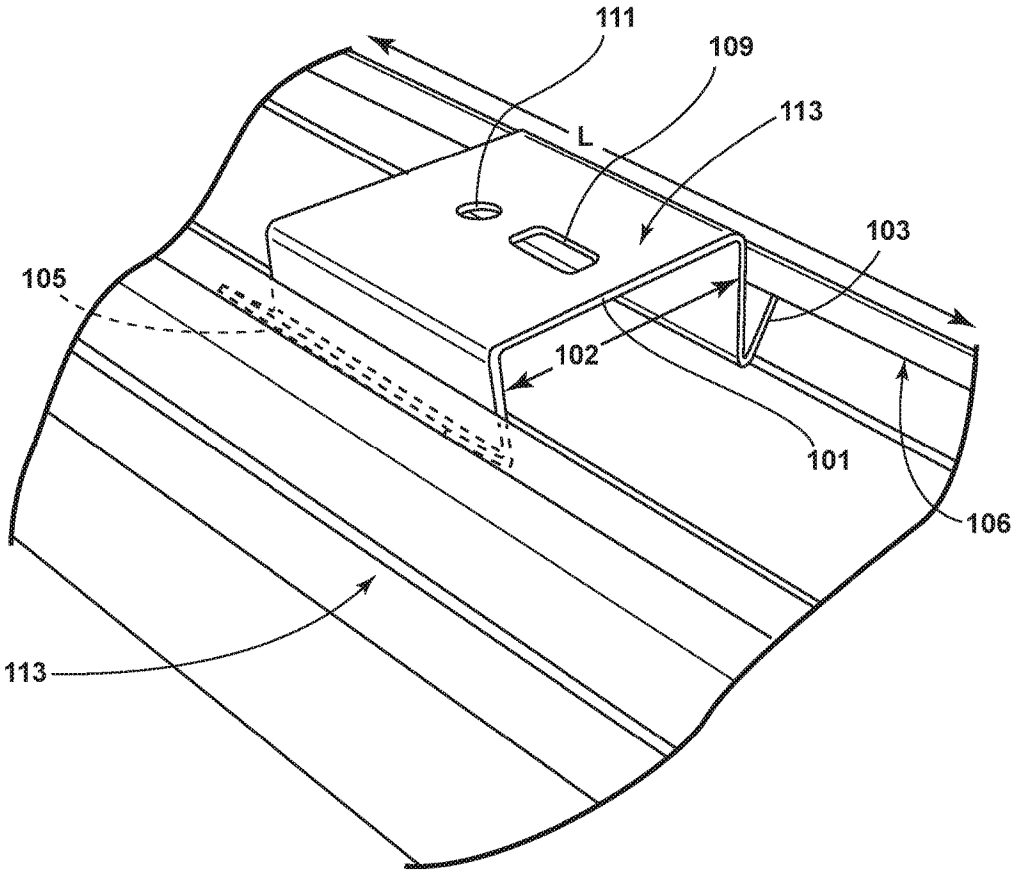
FIG. 12 is a fragmentary perspective view illustrating a hangar clip according to one embodiment.

FIG. 12 illustrates a snap-in mounting clip 101, which is rectangular in cross-section 102 and has respective wings 103, 105, which snap into grooves 105, 107 in a second illustrative embodiment of a power system extrusion 113. Illustrative embodiments of the power extrusion 113 may be constructed as illustrated in FIG. 3.

According to the embodiment of FIG. 12, the clip 101 may slide along the length "L" of the extrusion 113 and may thus be positioned at any point along that length "L." The clip 101 has apertures 109, 111 in its top surface 113, which facilitate connection of various mechanisms, for example, such as chains or cables for suspending a light fixture comprising extrusion 113 from a ceiling or other surface. During installation of such a fixture, the clip 101 provides the advantage that it may be moved to a position directly beneath a suspension chain or cable so that the chain or cable is vertically oriented, rather than requiring it to be angled to accommodate a fixed-in-place interconnection mechanism. As will be appreciated, in illustrative embodiments according to FIG. 12, light modules, e.g. 15, are mounted on an underside of the extrusion 113 so as to direct illumination in a downward direct mode.

The plug together light fixture modules of illustrative embodiments have the advantage that wiring between the modules, e.g. 16, 20 does not have to be disconnected and then re-connected to disassemble modules for service or other reasons or to initially assemble modules, thus avoiding the necessity to match one wire to another (e.g., "blue wire" to "red wire") or to insert individual wires into interconnecting devices, for example, such as wire nuts. Thus, a great savings in labor costs, as well as increased connection simplicity and reliability is achieved.

From the foregoing, those skilled in the art will appreciate that various adaptations and modifications of the just described illustrative embodiments can be configured without departing from the scope and spirit of the invention. Therefore, it is to be understood that, within the scope of the appended claims, the invention may be practiced other than as specifically described herein.

What is claimed is:

1. An LED light fixture apparatus comprising:

a power system extrusion formed of heat conductive material and having an opening defined between first and second surfaces thereof, the power system extrusion further having a channel formed in an interior thereof, the channel being configured to receive a power system extrusion electrical connector, the power system extrusion further having first and second horizontally facing channels formed in said interior, an LED light module attachable to said power system extrusion and shaped so as to close said opening so as to define a chamber within the power system extrusion and the LED light module, the LED light module having a surface mounting a circuit board carrying at least one LED;

a female end cap shaped to close a first end of said chamber, the female end cap having a horizontally extending tongue shaped and dimensioned to slidably mate with said first and second horizontally facing channels, said female end cap having an opening located in a vertical face thereof shaped to receive a first female electrical connector and first and second slots formed in said vertical face;

a male end cap having a horizontally extending tongue shaped and dimensioned to slidably mate with said first and second horizontally facing channels, said male end cap further having an opening located in a vertical face thereof shaped to receive a first male electrical connector and first and second tongues projecting from the vertical face and shaped to mate with said first and second slots of said female end cap; and a power box component having respective slots positioned to mate with the respective tongues of said male end cap and having a second female electrical connector positioned to mate with the first male electrical connector, the power box component having an electrical cable extending through a surface thereof and configured to be attached to a source of electrical power external to said LED light fixture.

2. The LED light fixture of claim 1 wherein said first male electrical connector comprises a five pin electrical connector and wherein said first female electrical connector comprises a five receptacle electrical connector wherein each of the five receptacles is configured to mate with a respective one of the five pins.

3. The LED light fixture of claim 2 wherein each of the first male and first female electrical connectors have a trapezoidal cross-section.

4. The LED light fixture of claim 1 further comprising an LED driver module located within said chamber and a mounting bracket configured to mount to an under surface of said LED light module, the mounting bracket being spring biased so as to press a surface of the LED driver module against the interior of said power system extrusion when the LED light module and extrusion are attached together so as to improve heat transfer from the driver module to the power system extrusion.

5. The LED light fixture of claim 4 wherein said LED driver module is configured to receive an AC input voltage and output a DC voltage.

6. The LED light fixture of claim 5 wherein said AC input voltage is a line input voltage.

7. An LED light fixture comprising:

a power system extrusion formed of heat conductive material having a flat interior floor, first and second vertical sidewalls, respective horizontally running wings projecting upwardly from respective side top surfaces thereof, and an opening defined between said first and second horizontally running wings, the power system extrusion further having a horizontally running channel configured to receive an electrical connector and formed on the interior of one of said first and second sidewalls and first and second horizontally facing channels formed on said flat interior floor, the opening of the first channel facing the opening of the second channel;

an LED light module having a rectangular module body attached to said power system extrusion and shaped so as to close said opening so as to define a closed chamber within the power system extrusion and the LED light module, the LED light module having a surface mounting a circuit board carrying at least one LED; the LED light module further having interior side surfaces positioned to contact the respective inner sides of said horizontally running wings;

a female end cap shaped to close a first end of said chamber, the female end cap having a horizontally extending tongue shaped and dimensioned to slidably mate with said first and second horizontally facing channels, said female end cap having an opening located in a vertical face thereof shaped to receive a first female electrical connector and first and second slots formed in a vertical front face thereof;

a male end cap having a horizontally extending tongue shaped and dimensioned to slidably mate with said first and second horizontally facing channels and respective horizontally running wings projecting upwardly from respective side top surfaces thereof and shaped and positioned to align with the horizontally running wings of said power system extrusion and to contact the interior side surfaces of said LED module, said male end cap further having an opening located in a vertical face thereof shaped to receive a first male electrical connector and first and second tongues projecting from said vertical face and shaped to mate with said first and second slots; and a power box component having respective slots positioned to mate with the respective tongues of said male end cap and having a second female electrical connector positioned to mate with the first male electrical connector mounted in said male end cap and shaped to close a second end of said chamber, the power box component having an electrical cable extending through a surface thereof and configured to be attached a source of electrical power external to said LED light fixture.

8. The LED light fixture of claim 7 further comprising an LED driver module located within said chamber and a mounting bracket mounted to an under surface of said LED light module, the mounting bracket being spring biased so as to press a surface of the LED driver module against the flat interior floor of said power system extrusion so as to improve heat transfer from the driver module to the power system extrusion.

9. The LED light fixture of claim 7 wherein said first male electrical connector comprises a five pin electrical connector and wherein said second female electrical connector comprises a five receptacle electrical connector wherein each of the five receptacles is configured to mate with a respective one of the five pins.

10. The LED light fixture of claim 9 wherein each of the first male and second female electrical connectors have a trapezoidal cross-section.

11. An LED light fixture apparatus comprising:

first and second LED light fixture modules, each LED light fixture module comprising:

a power system extrusion having an open top and first and second open ends, the power system extrusion comprising a channel configured to conduct a plurality of electrical leads to a power system extrusion electrical connector, the power system extrusion electrical connector being configured to tap power from said plurality of electrical leads for supply to an LED driver module;

a first end cap attached to the first open end of the power system extrusion and closing said first open end, said first end cap having a first female electrical connector located in a front face thereof;

a second end cap attached to the second open end of the power system extrusion and closing said second open end, the second end cap having a male electrical connector located in a front face thereof, the male electrical connector being of a type which mates with said first female electrical connector;

an LED light module having a circuit board mounted in a recessed area of a top surface thereof, the circuit board carrying one or more LEDs, the LED light module being removably attachable to close the open top end of said power system extrusion;

an LED driver module disposed within a chamber formed by said LED light module and said power system extrusion for supplying power to said one or more LEDs;

wherein the male electrical connector of the second end cap of one of said first and second LED light fixture modules is plugged into the female electrical connector of the first female end cap of the other one of the first and second LED light fixture modules; and wherein one of the second end caps has a horizontally extending tongue shaped and dimensioned to slidably mate with first and second horizontally facing channels of one of said power system extrusions, said one of the second end caps further having an opening located in the front face thereof shaped to receive the first male electrical connector.

12. The LED light fixture of claim 11 further comprising a power box component having respective slots positioned to mate with respective first and second tongues projecting from the front face of one of said second end caps, the power box component further having a second female electrical connector positioned to mate with the male electrical connector of said one of said second end caps, the power box component having an electrical cable extending through a surface thereof and configured to be attached to a source of electrical power external to said LED light fixture.

13. The LED light fixture of claim 12 wherein each said male electrical connector comprises a five pin electrical connector and wherein each said second female electrical connector comprises a five receptacle electrical connector wherein each of the five receptacles is configured to mate with a respective one of the five pins.

14. The LED light fixture of claim 13 wherein each of the male electrical connectors and the second female electrical connector have a trapezoidal cross-section.

15. An LED light fixture apparatus comprising:

first and second LED light fixture modules, each LED light fixture module comprising:

a power system extrusion having an open top and first and second open ends, the power system extrusion comprising a channel configured to conduct a plurality of electrical leads to a power system extrusion electrical connector, the power system extrusion electrical connector being configured to tap power from said plurality of electrical leads for supply to an LED driver module;

a first end cap attached to the first open end of the power system extrusion and closing said first open end, said first end cap having a first female electrical connector located in a front face thereof;

a second end cap attached to the second open end of the power system extrusion and closing said second open end, the second end cap having a male electrical connector located in a front face thereof, the male electrical connector being of a type which mates with said first female electrical connector;

an LED light module having a circuit board mounted in a recessed area of a top surface thereof, the circuit board carrying one or more LEDs, the LED light module being removably attachable to close the open top end of said power system extrusion;

an LED driver module disposed within a chamber formed by said LED light module and said power system extrusion for supplying power to said one or more LEDs;

wherein the male electrical connector of the second end cap of one of said first and second LED light fixture modules is plugged into the female electrical connector of the first end cap of the other one of the first and second LED light fixture modules; and wherein one of the first end caps is shaped to close a first end of said chamber, the said one of the first end caps having a horizontally extending tongue shaped and dimensioned to slidably mate with first and second horizontally facing channels located at said first end, said one of said first end caps having an opening located in the front face thereof shaped to receive a first female electrical connector, the front face further having first and second slots formed therein.

16. The LED light fixture of claim 15 wherein the power tapped from said power extrusion s stem electrical connector for supply to an LED driver module is A.C. line power.

17. An LED light fixture apparatus comprising:

first and second LED light fixture modules, wherein one of the first and second LED light fixture modules directly plugs into the other one of the first and second LED light fixture modules, each LED light fixture module comprising:

a power system extrusion having first and second open ends;

a first end cap attached to the first open end of the power system extrusion and closing said first open end, said first end cap having a female electrical connector located in a front face thereof;

a second end cap attached to the second open end of the power system extrusion and closing said second open end, the second end cap having a male electrical connector located in a front face thereof, the male electrical connector being of a type which mates with said female electrical connector;

an LED light module having a circuit board mounted in a recessed area thereof, the circuit board carrying one or more LEDs, the LED light module being removably attachable to said power system extrusion;

an LED driver module for supplying power to said one or more LEDs; and a mounting bracket attached to said LED driver module, the mounting bracket being attached to the LED light module by a resilient biasing mechanism which forces a surface of said LED driver module against a surface of said power system extrusion;

wherein the male electrical connector of the second end cap of one of said first and second LED light fixture modules is plugged into the female electrical connector of the first end cap of the other one of the first and second LED light fixture modules.

18. An LED light fixture apparatus comprising:

first and second LED light fixture modules, each LED light fixture module comprising:

a power system extrusion having an open top and first and second open ends, the power system extrusion comprising a channel configured to conduct a plurality of electrical leads to a power system extrusion electrical connector, the power system extrusion electrical connector being configured to tap power from said plurality of electrical leads for supply to an LED driver module;

a first end cap attached to the first open end of the power system extrusion and closing said first open end, said first end cap having a first female electrical connector located in a front face thereof;

a second end cap attached to the second open end of the power system extrusion and closing said second open end, the second end cap having a male electrical connector located in a front face thereof, the male electrical connector being of a type which mates with said first female electrical connector;

an LED light module having a circuit board mounted in a recessed area of a top surface thereof, the circuit board carrying one or more LEDs, the LED light module being removably attachable to close the open top end of said power system extrusion;

an LED driver module disposed within a chamber formed by said LED light module and said power system extrusion for supplying power to said one or more LEDs;

wherein the male electrical connector of the second end cap of one of said first and second LED light fixture modules is plugged into the female electrical connector of the first end cap of the other one of the first and second LED light fixture modules; and the LED light fixture apparatus further comprising a mounting bracket mounted to an under surface of each said LED light module, the mounting bracket being spring biased so as to press a surface of the LED driver module against a flat interior floor of the power system extrusion to which the respective LED light module is removably attachable so as to improve heat transfer from each LED driver module to its respective power system extrusion.

* * * * *